United States Patent [19]

Schleicher

[11] 4,274,075

[45] Jun. 16, 1981

[54] ELECTRONIC MULTI-RANGE VARIABLE RESISTOR

[75] Inventor: Helmut Schleicher, Berlin, Fed. Rep. of Germany

[73] Assignee: Schleicher GmbH & Co. Relais-Werke KG, Fed. Rep. of Germany

[21] Appl. No.: 49,339

[22] Filed: Jun. 18, 1979

Related U.S. Application Data

[63] Continuation of Ser. No. 821,806, Aug. 4, 1977, abandoned.

[30] Foreign Application Priority Data

Nov. 18, 1976 [DE] Fed. Rep. of Germany ... 7636488[U]

[51] Int. Cl.[3] ..... H01H 19/18

[52] U.S. Cl. ..... 338/172; 338/200; 338/215; 338/128

[58] Field of Search ..... 200/11 R, 11 TW, 14, 200/18, 336, 308; 334/47, 49–51; 338/122–124, 131, 134, 179, 200, 191, 215, 128, 172; 361/331

[56] References Cited

U.S. PATENT DOCUMENTS

| | | | |
|---|---|---|---|
| 1,897,596 | 2/1933 | Tietz | 338/123 |
| 2,884,505 | 4/1959 | Strain | 338/124 |
| 3,230,491 | 1/1966 | Drefus | 338/123 |
| 3,380,010 | 4/1968 | De Young | 338/122 |

*Primary Examiner*—Gerald P. Tolin

*Attorney, Agent, or Firm*—Basile, Weintraub & Hanlon

[57] ABSTRACT

The application discloses an electronic multirange step resistor for adjustment of a timing relay with an analog adjustment which is equipped with a switch for the selection of the various resistance ranges and which is further equipped with a turning knob for the analog adjustment within each selected range.

5 Claims, 2 Drawing Figures

ELECTRONIC MULTI-RANGE VARIABLE RESISTOR

CROSS REFERENCE TO RELATED APPLICATIONS

This application is a continuation of copending application Ser. No. 821,806, filed Aug. 4, 1977 entitled "Electronic Multi-Range Timing Relay" now abandoned.

BACKGROUND OF THE INVENTION

I. Field of the Invention

The present invention relates to an electronic multi-range step resistor with analog adjustment.

II. Description of the Prior Art

A significant advantage of an electronic step resistor for adjustment of a timing relay in comparison to the known mechanical timing relays is the reduced return time of the timing unit and an always constant precision for the time adjustment in the entire timing range, since the inevitable coupling errors, in case of the mechanical timing relays, are here nonexistent. In addition, electronic timing relays are already advantageous for special fields of application because they make possible time adjustments, that is, the delay of switch positions, down to the range of 10 milliseconds. They can be operated within a very large frequency range independent of the frequency of the power source. Operation with direct current is possible with only little effort.

The objective for the construction and the production of such electronic step resistor for adjustment of timing relays is by far different in comparison with the mechanical timing relays since the electronic step resistor does not use any electromechanical power source and therefore does not use any moving parts, such as the synchronous motor, the reducing gear, coupling devices, and a timing wheel such as are normally used for mechanical timing relays.

Electronic timing relays have been known for some time in the form of versions, such as the condenser relays, as well as in the form of versions with electronic tubes, or in the form of more modern versions which are completely transistorized. Especially popular are electronic timing relays; for instance, wipe relays, blink relays, and impulse supply units. The timing transient for electronic time relays is preferably supplied by means of RC units which will then define the desired delay time. Condenser relays are mainly characterized by the fact that the resistance in the RC unit is small, whereas condensers of high capacity are used.

In addition to the single-range timing relays, such as for the electromechanical timing relays or for the electronic timing relays, multi-range relays are also known. In case of these relays, individual time ranges, for instance up to one second, ten seconds, one minute, ten minutes or one hour, can be selected by means of a switch; and with another turning knob a continuous time adjustment can be chosen within each of the preselected ranges. The switch for the time ranges activates a selection switch with which, for instance, different resistors can be looped into the RC unit or taken out of the RC unit, and the turning knob is connected with a potentiometer by means of an access or a shaft which continuously varies the fixed resistors in the given range which was selected by means of the switch. Both knobs necessary for operation, that is to say, the switch and the turning knob, are located at the front of the electronic timing relay at a distance therefrom. The general trend for the miniaturization of such devices brought about housing dimensions in recent years which necessitated the construction of operating knobs which were very small with regard to their diameter and which operating knobs had to be positioned relatively close to each other. In this way, the corresponding scales had to be constructed smaller and smaller which resulted necessarily in a larger error of adjustment. This adjustment error, for one thing, is caused by the unfavorable optical readability of the data to be adjusted on the small scale and, on the other hand, by the unfavorable manual handling of the small operating knobs which are located in close proximity to each other.

The historical development continued in such a way that as first analog adjustment units were used; and after miniaturization had taken place, due to the large adjustment errors, a change was made towards digital adjustment possibilities by means of (dial) decade switches or similar equipment. However, this caused considerable, additional cost.

On the other hand, mechanical multi-range timing relays are known in which the switch for the individual time ranges is located centrally on top of the turning knob for the continuous time selection within the time range, which turning knob covers a large portion of the frontal plate and which transparent turning knob overlaps the scales. A location in such a way enables not only an especially easy and accurate manipulation of both of the knobs, but it also makes optimum or maximum use of the available vertical area of the frontal plate of the time relay for the manual operating devices. The location of the scale underneath the transparent turning knob does not create any difficulties with regard to space. Even for miniaturized relays, the scale can be read even from a considerable distance due to its possible size.

The mentioned location of one of the operating knobs above the other for a multi-range timing relay is possible for mechanical time relays since here the switch for the individual time ranges activates a system of gears which couple various different reduction gear steps of a reduction gear to the synchronous motor which activates the mechanical time relay, and the turning knob for the continuous time selection controls the timing reel.

III. Prior Art Statement

The above description of the prior art, in the opinion of applicant, represents the closest prior art of which applicant is aware.

SUMMARY OF THE INVENTION

It is the objective of the present invention to permit the use of the above-mentioned advantages of the location of the operating knobs in a central position, one on top of the other, which is known because it is possible for mechanical timing relays and also for analog time selection for electronic timing relays.

The resolving of this task according to the invention is achieved by the characteristics which are characterized in claim 1.

Advantageous modifications and versions of this solution of the problem are set forth in the remaining, dependent claims.

Due to the fact that I have deviated for the first time for a variable resistor for electronic timing relays from the side-by-side location of both of the operating knobs for the individual timing ranges on the one hand and for the continuous time adjustment within a time range on the other hand which was deemed necessary up to the present time, the same advantages with regard to the adjustment possibilities result which were known so far only for some of the mechanical timing relays. The large transparent turning knob which overlaps and substantially encloses the scales guarantees a secure handling, an exact analog adjustment and an exact readability. The switch for the individual resistance ranges which is centrally located on top of the turning knob can be easily operated, even if it is relatively small in diameter, since in this position on top of the turning knob, it is not hindered by the other knob. In addition, this switch is adjustable only with regard to certain fixed positions, and it can only define the individual ranges to be selected.

BRIEF DESCRIPTION OF THE DRAWING

The enclosed drawing shows an example of a version of the invention wherein the following figures are shown.

DESCRIPTION OF THE PREFERRED EMBODIMENT

Figure 1:
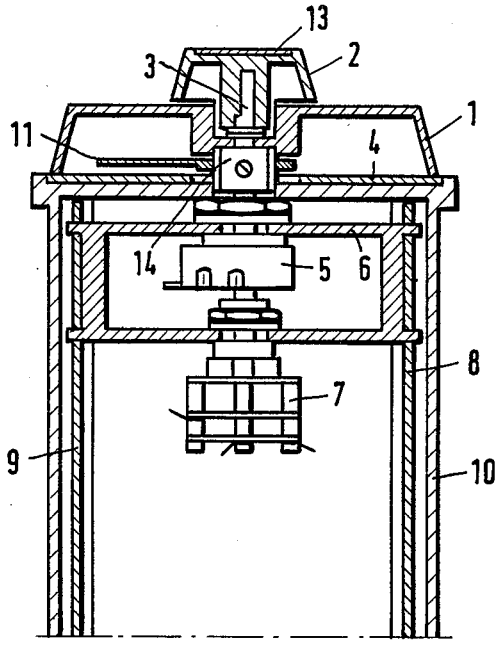
FIG. 1 is a vertical cross-section through the frontal part of an electronic timing relay according to the invention.
Figure 2:
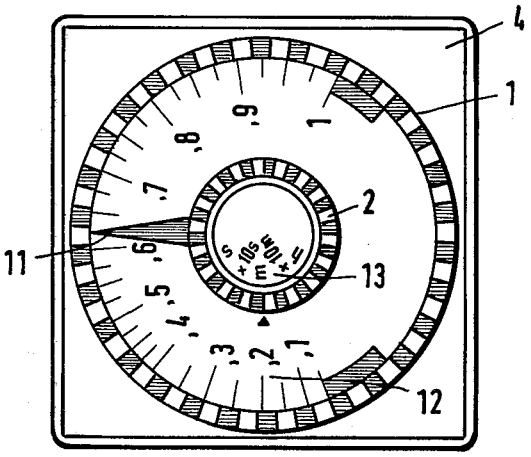
FIG. 2 is a view from the top of the frontal plate of a time relay according to FIG. 1.

It is shown in the drawing that the electronic multi-range step resistor with analog adjustment is enclosed by a housing 10 which encloses in the shown version, for example, two plates 8 and 9 onto which plates 8 and 9 are mounted electronic building blocks for the operation of the time relay, which are not shown in detail.

The front part of the housing 10 is equipped with a frontal plate 4 on which there is located a time scale 12. The time scale 12 is overlapped by a turning knob 1 which takes up the main portion of the area of the frontal plate 4 and which is transparent at least in its upper frontal section under which the time scale 12 is located. The slanted peripheral area of the turning knob 1 substantially encloses the time scale 12 and is rippled; that is to say, it has many small grooves or it is made slip proof in some other way. A pointer 11 can be moved continuously across the time scale 12 by means of the turning knob 1 where the pointer and turning knob are attached to a hollow shaft. The other end of the hollow shaft is attached to the shaft of an adjustment unit, such as potentiometer or variable resistor 5. The attachment of the turning knob 1 and the pointer 11 to the hollow shaft is achieved by means of the attachment unit 14.

A second shaft 3 is passed through the hollow shaft which carries the turning knob 1 and the pointer 11. On the end of this second shaft which is protruding from a turning knob 1 there is located a switch or knob 2 for the selection of individual resistance ranges. On the end of the shaft 3, which is opposite the switch knob 2, a selection switch 7 is located which selects the desired ranges due to individual, fixed resistors being switched into the time unit of the electronic timing relay. Thus, the shaft 3 is independently operable due to its being led centrally through the turning knob 1 and the potentiometer 5 in the way shown, and it is furthermore led through a bridge-type support 6 onto which the potentiometer 5 and the selection switch 7 are in a suitable way mounted and attached.

The bridge-type support 6 forms a type of double plate which leaves enough space for the potentiometer 5 whereas outside of the space which is formed by it the selection switch 7 is located. The bridge type support 6 is attached to both plates 8 and 9 which carry the electrical building blocks, which plates 8 and 9 are positioned parallel to the opposite walls of the housing 10.

A scale 13 which is mounted on the upper, frontal side of the knob 2 shows the information for the individual time ranges which can be preselected. The adjustment precision of the resistance adjustment unit, such as described above for the electronic time relay, is improved by a factor of three in comparison to the known side-by-side location of the switch and turning knob.

While only one example of the present invention has been disclosed, it should be apparent to those skilled in the art of electronic multi-range step resistor with analog adjustment that other forms of applicant's invention may be had, all coming within the spirit of the present invention and scope of the appended claims.

What is claimed is as follows:

1. An electronic multi-range resistor with a variable adjustment for the selection of resistances within each range comprising:

a housing including a front end;

a frontal plate enclosing the front end;

a scale located on the frontal plate;

a bridge support disposed in the housing comprising a pair of spaced plates spaced from the frontal plate with central apertures formed in the plates aligned with apertures in the center of the scale and frontal plate, the apertures being concentric to each other;

a hollow shaft potentiometer located between the bridge plates and mounted to the one bridge plate nearest the frontal opening, with the hollow shaft projecting through the apertures for variable resistance selection;

a turning knob including a transparent upper frontal section spaced from and overlapping the scale, said turning knob further including a slip proof, rippled, and slanted peripheral area substantially enclosing the scale and engaging the frontal plate, the turning knob attached to the hollow shaft for rotation therewith;

a pointer attached to the hollow shaft for rotation therewith and continuously movable across the scale;

a selection switch with individual fixed resistors affixed to the other bridge plate defining a plurality of ranges of resistance;

a shaft of the selection switch passing centrally through the hollow shaft and protruding through the turning knob; and a knob radially smaller than the turning knob, and concentrically disposed therewith, said knob attached to an end of the selection switch shaft for the selection of certain of the fixed resistors.

2. The multi-range resistor according to claim 1 characterized by the fact that the shaft of the selection switch is passed centrally through the axis of the potentiometer.

3. The multi-range resistor according to claim 1 characterized by the fact that the shaft of the selection switch penetrates said bridge-like support which is supported by two plates, which bridge-like support supports the potentiometer and the selection switch, which selection switch is positioned on the other end of the selection switch shaft opposite from the smaller knob.

4. The multi-range resistor according to claim 1 characterized by the fact that the turning knob overlaps the frontal plate completely.

5. The multi-range resistor according to claim 1 characterized by the fact that the turning knob is equipped with the scale and the front plate is equipped with the pointer.

* * * * *